United States Patent [19]

Wall et al.

[11] 4,289,475

[45] Sep. 15, 1981

[54] STEAM VAPORIZATION OF OIL

[75] Inventors: Fraser M. Wall, Warrington; Maurice R. Kitzen, Wyncote; T. Frederick Kreipe, Oreland, all of Pa.

[73] Assignee: Selas Corporation of America, Dresher, Pa.

[21] Appl. No.: 756,848

[22] Filed: Jan. 5, 1977

[51] Int. Cl.[3] ..... F23D 11/44; F27B 5/14

[52] U.S. Cl. ..... 431/11; 431/212; 431/161; 48/214 R

[58] Field of Search ..... 431/11, 3, 4, 161, 163, 431/207, 211, 212, 121; 122/488–492; 60/39.53, 39.59; 252/373; 48/214 R; 422/182

[56] References Cited

U.S. PATENT DOCUMENTS

| | | | |
|---|---|---|---|
| 977,208 | 11/1910 | Maxim | 431/4 |
| 1,097,066 | 5/1914 | Turner | 431/212 |
| 1,420,957 | 6/1922 | Bishop | 431/163 |
| 1,520,624 | 12/1924 | Wiederwax | 431/11 |
| 1,553,986 | 9/1925 | Clyde | 431/212 |
| 1,766,243 | 6/1930 | Cannon | 431/3 |
| 1,818,901 | 8/1931 | Mallery | 431/4 |
| 2,023,074 | 12/1935 | Harman | 431/4 |
| 2,087,399 | 7/1937 | Elfving et al. | 431/211 X |
| 2,295,501 | 9/1942 | Jones | 431/163 X |
| 2,818,110 | 12/1957 | Rulseh | 431/3 |
| 3,291,191 | 12/1966 | Stoops | 431/211 X |
| 3,363,993 | 1/1968 | Campbell | 422/182 |
| 3,381,896 | 5/1968 | Winters | 431/121 X |
| 3,407,789 | 10/1968 | Hallee et al. | 48/214 R X |
| 3,531,267 | 9/1970 | Gould | 48/214 R X |
| 3,836,344 | 9/1974 | Krawitz et al. | 48/214 R X |
| 4,025,282 | 5/1977 | Reed et al. | 431/11 |
| 4,089,805 | 5/1978 | Gambrell | 252/373 |
| 4,140,472 | 2/1979 | Hoehing et al. | 431/37 |
| 4,140,473 | 2/1979 | Hoehing et al. | 431/11 |

*Primary Examiner*—Larry Jones

*Attorney, Agent, or Firm*—Miller & Prestia

[57] ABSTRACT

For use as a replacement for existing gas to burners, oil having an API gravity of about 10–80 is preheated and mixed with about 0.1 to 1 pound of steam per pound of oil, at a pressure of about 30–150 pounds per square inch gauge. The resulting mixture is heated to a temperature above the condensation temperature of the mixture, the temperature being approximately in the range of 450°–800° F. The mixture has flow properties which are essentially equivalent to those of gas under the same conditions of temperature and pressure. The mixture is delivered to the nozzle of the gas burner and is burned therein.

An apparatus is provided for burning either oil or gas, and includes a gas burner having nozzle means for mixing air and gas, a gas conduit connected thereto, and an oil supply also connected to the burner, the oil supply being fed from an oil vaporizing apparatus as just described above.

41 Claims, 2 Drawing Figures

STEAM VAPORIZATION OF OIL

BRIEF DESCRIPTION OF THE INVENTION

This invention relates to an apparatus and method for producing vaporized liquid hydrocarbon using steam assistance, which can be substituted directly for gas as a fuel supplied to burners and more particularly relates to an apparatus and method for producing a vaporized steam-hydrocarbon mixture having such flow properties that it is substantially completely interchangeable with gas.

It has been found that liquid hydrocarbons can be vaporized by mixing with steam, and that the resulting mixture may be heated to a mixture temperature which is above the condensation temperature of the mixture at the nozzle, and that this mixture can be so controlled that it has flow properties which are essentially equivalent to those of gas, which is normally introduced to the gas nozzle at approximately ambient temperature. The flow properties of the fuel are particularly important in the case of inspirator burners, in which the fuel itself is conducted through an orifice in a manner to cause or substantially cause and influence the rate of flow of the inspirated air which is drawn into the nozzle area under the influence of the flow of the fuel.

An excellent measure of the flow properties of fuel for the purpose referred to above is reflected in the Wobbe Number of the fuel. The Wobbe Number is defined as the higher heating value of the fuel under existing conditions (usually expressed as Btu per cubic foot) divided by the square root of the specific gravity of the fuel under the same conditions. In view of the fact that gas is usually fed to the nozzle under substantially ambient conditions, its effective Wobbe number may be equated to a temperature of about 60° F. It has been discovered that, where the Wobbe Number of gas is in the range of about 500 to 1,500, preferably about 1000 to 1500, it is possible to produce a vaporized hydrocarbon-steam mixture at an elevated temperature in the range of about 450° F. to 800° F., with the steam being present in the quantity of 0.1 pound of steam per pound of hydrocarbon, in such a manner that the Wobbe Number of the hydrocarbon-steam mixture is also in the range of about 500 to 1,500, preferably about 1,000 to 1,500.

Such a hydrocarbon-steam mixture, having a Wobbe Number substantially equivalent to that of the gas at the intended gas introduction temperature, is substantially completely interchangeable with the gas and may be introduced directly to the nozzle through the same line of introduction as was previously used in the operation of any existing gas-fired burner.

Although the utilization of a hydrocarbon-steam mixture having a Wobbe Number comparable to that of gas is particularly advantageous in connection with the so-called inspiration type burners, such mixtures may also be utilized effectively in nozzle mix burners or in other burners constructed and arranged for the utilization of gas as a fuel.

The liquid hydrocarbons which may be utilized in accordance with this invention are generally in the range extending from naphtha to No. 6 oil, which range corresponds to approximate average molecular weights of from about 80 to about 400. They include naphtha, gasoil and heating oils ranging from No. 2 to No. 6. The foregoing designations are based upon current U.S. usage and it should be recognized that different designations are used for corresponding liquid hydrocarbons in other countries.

DISCUSSION OF THE PRIOR ART

Various gaseous fuels have been utilized in substantial quantities as fuels for burners producing heat for a wide variety of end uses. Natural gaseous fuels include methane, ethane, propane and heavier hydrocarbon compounds, and combinations of these and other manufactured gases such as hydrogen and carbon monoxide are also used. Burners designed for utilizing such gases are provided with orifices of a proper size for forming a desirable combustion mixture with air. Inspiration type gas burners are, accordingly, particularly designed for burning a particular fuel gas, and are not appropriately designed for the direct substitution of oil for the gas.

It is becoming increasingly important in the operation of burners, furnaces and the like to provide the capability of burning either gas or oil. In such a case, in any given locality, the operator is not limited to one or the other fuel as a source, and is independent of problems relating to the scarcity or high price of one of these fuels or the other. Furnaces have been provided in the past, in which separate oil burners and separate gas burners are provided, and wherein separate sets of piping are provided for the introduction of either such fuel independently of the other.

Such dual installations are, of course, expensive and difficult to operate and to maintain. It is accordingly an object of this invention to provide an installation in which oil may be substituted directly for gas.

Although this invention applies to a wide variety of burners, including burners of the nozzle mix type, and also to burners furnished with primary air by inspiration and secondary air also provided around the burner nozzle, it has particular utility and advantage in connection with the so-called "Duradiant" burners manufactured by Selas Corporation of America, of Dresher, Pa. These burners utilize a venturi and the energy of a high pressure gas stream to supply all or a part of the air requirements, achieve intimate mixing and effect rapid and complete combustion within the confines of a ceramic cup. The products of combustion wipe the surrounding ceramic surface by distribution through an appropriate tip, with numerous radial openings spaced around its outer circumference. Such a burner, of the type disclosed and claimed in the U.S. Patent to Hess No. 2,215,079, granted Sept. 17, 1940, assigned to Selas Corporation of America, of Dresher, Pa., for example, produces an incandescent surface on the ceramic cup, which radiates energy to any available heat sink. In such a burner the combustion is so rapid and complete, since stoichiometric proportions of fuel and air are used, that when viewed from the side no appreciable flame is visible beyond the periphery of the burner cup. This is highly advantageous since it makes it possible to place the burner in close proximity to the surface being heated, without danger of flame impingement.

In various modifications of this type of burner, depending upon the characteristics of the gaseous fuel and the heat release capacity desired, a proportion of air as high as 20% of the total requirements might be introduced through an annulus between the tip and the burner cup which permits inflow by virtue of the lower pressure that exists on the combustion side of the burner as opposed to the outside of the furnace at the same burner level (i.e., draft).

In other embodiments of this burner, combustion air is supplied entirely by induced or forced draft, and the venturi is thus rendered unnecessary. In all such designs, however, a homogeneous mixture of air and fuel must be attained in proper proportions so that high speed combustion always occurs as the mixture issues from the burner tip to impart its heat to the ceramic surface of the cup. The ability to maintain stoichiometric proportions of fuel and air keeps the combustion temperature at its highest level since the combustion products are undiluted by excess air. This provides peak efficiency for heat transfer.

The foregoing forms of burners may utilize, of course, hydrocarbons which are gaseous at normal ambient temperatures. These include so-called natural gas, and gases including methane, ethane, propane and the butanes, and combinations of these with each other, and other manufactured gases such as mixtures of hydrogen and carbon monoxide, for example.

In the case of hydrocarbon fuel starting with 5-carbon atom molecules (the pentanes and heavier), these are normally liquids at ambient temperatures although they may contain small quantities of lighter materials. In the utilization of any such liquid hydrocarbon fuels, it has been found necessary in order to achieve the desired high speed combustion within a burner cup, that regular droplets with minimum particle size be delivered, so that intimate mixing with air is rapidly achieved.

Conventional type burners utilize steam combined with a pressure drop across a spray nozzle to produce the necessary atomization. Typical patents showing such structures include U.S. Pat. Nos. 1,454,975, 1,492,674, 2,023,074, and many others. Depending upon the boiling range of the liquid fuel, steam consumption can vary from 0.2 to 0.3 pounds per pound of fuel to as high as 1.2 pounds per pound of fuel, the lower figures being normal with light naphthas and the higher figures being applicable to fuels as heavy as No. 4–6 oil, which can have a final boiling point as high as 800° F. and still be within specifications.

Since steam materially assists the atomization and thus the combustion process, the tendency exists to use higher quantities than nominally recommended. Although this improves the appearance of the combustion process by reducing luminosity and shortening the flame length, such excess materially increases operating costs and reduces flame temperature and thermal efficiency by providing a diluent. It is an important object and advantage of this invention to provide a process whereby fuels normally liquid at ambient temperature may be utilized and caused to perform like gaseous fuels with little loss in efficiency.

DRAWINGS

The foregoing and other objects and advantages of this invention are attained by the provision of a method and apparatus as described hereinafter, in conjunction with the drawings, which represent preferred embodiments of the invention, and are not intended to limit the scope of the claims.

FIG. 1 is a flow diagram illustrating one form of apparatus and method in accordance with this invention; and FIG. 2 is another flow diagram, illustrating another form of apparatus and method in accordance with this invention.

DETAILED DESCRIPTION

Figure 1:
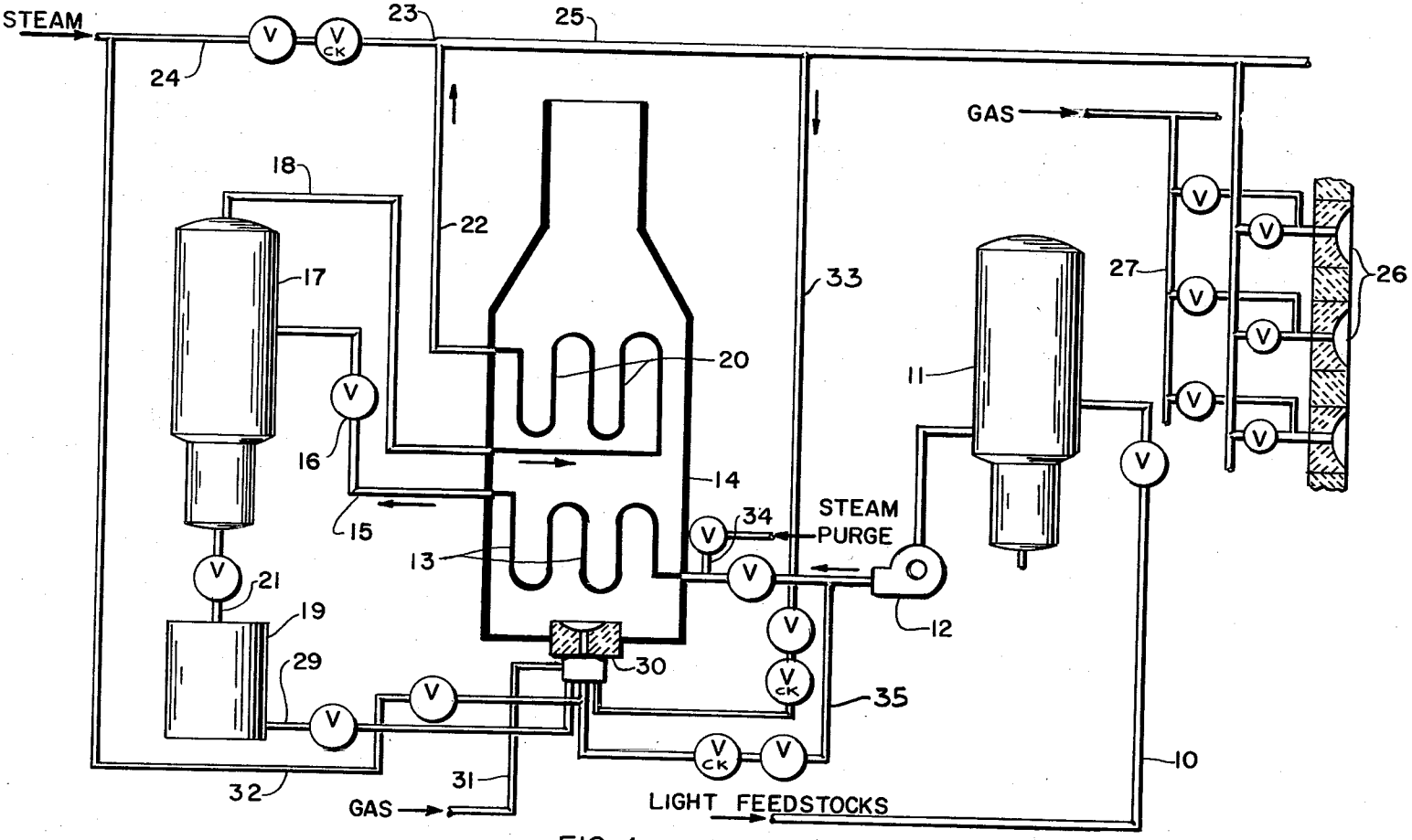

Turning now to the specific embodiment of the invention illustrated in FIG. 1, the number 10 designates a feed line for a light feed stock such as naphtha, which may be used as a fuel naphtha or a process feed naphtha, or both. As shown, the naphtha in the line 10 is conducted to a storage tank 11 and is then pumped by a pump 12 into a preheat coil 13 contained in a heater 14. The preheated hydrocarbon is conducted through a pipe 15 and a pressure reducing valve 16 to a flash tank 17, and the vaporized product passes through a pipe 18 into the hydrocarbon superheater coils 20 of the heater 14.

The bottoms from the flash tank 17, in the form of heavy hydrocarbons containing impurities, are passed to a storage tank 19 through the line 21.

The superheated hydrocarbon from coils 20 is conducted through a line 22, into which steam is inserted at the junction 23, through a steam pipe 24. The resulting homogeneous mixture of steam and vaporized hydrocarbon is conducted through a line 25 and is introduced as fuel into a gas inspiration burner 26. The number 27 designates the gas feed line for the gas inspiration burners 26. It will be appreciated that in actual practice, in many occasions, the line 25 is conducted to one of a series of manifolds connected in turn to a multiplicity of burners utilized in an industrial furnace or the like.

The heater or furnace 14 is heated by one or a plurality of burners, here shown diagrammatically as a single burner 30. Burner 30 is a dual fuel (flame type) burner and is connected to a gas line 31, to an atomizing steam line 32 connected from the steam line 24, and a recycle vaporized oil-steam line 33 leading from the line 25. A further feed line 29 may be provided, leading to burner 30 from heavy hydrocarbon storage tank 19, as an optional energy supply for the burner 30. A separate nozzle may be provided, if desired, for operation with a standard oil supply 35, particularly in start-up, if desired.

In the operation of the process shown in FIG. 1, steam is conducted through the line 25 in order to bring it up to temperature, and a steam purge is introduced through the line 34 for removal of air from the system. The burner 30 is lit off, utilizing gas from the line 31 and ambient air. As the system is brought up to temperature, light hydrocarbon feed stock is introduced through the line 10 and, as light hydrocarbon passes from the superheater coil 20, it is merged with steam from the line 24 at the point 23, forming a mixture having substantially the same flow and combustion properties as natural gas.

This mixture is then introduced into the gas inspiration burner 26 and is burned in essentially the same manner as gas.

It will be appreciated that in view of the fact that a separation is taking place in the flash tank 17 with separation of heavy and impure hydrocarbons, this particular form of apparatus and process is particularly useful for lighter feed stocks such as naphtha containing trace heavier components or impurities. In the event that such a process were used with a heavier hydrocarbon feed stock the problem of coking might be found to present itself, and in such a circumstance it is considered preferable to use a somewhat modified process, as disclosed in FIG. 2 of the drawings.

Figure 2:
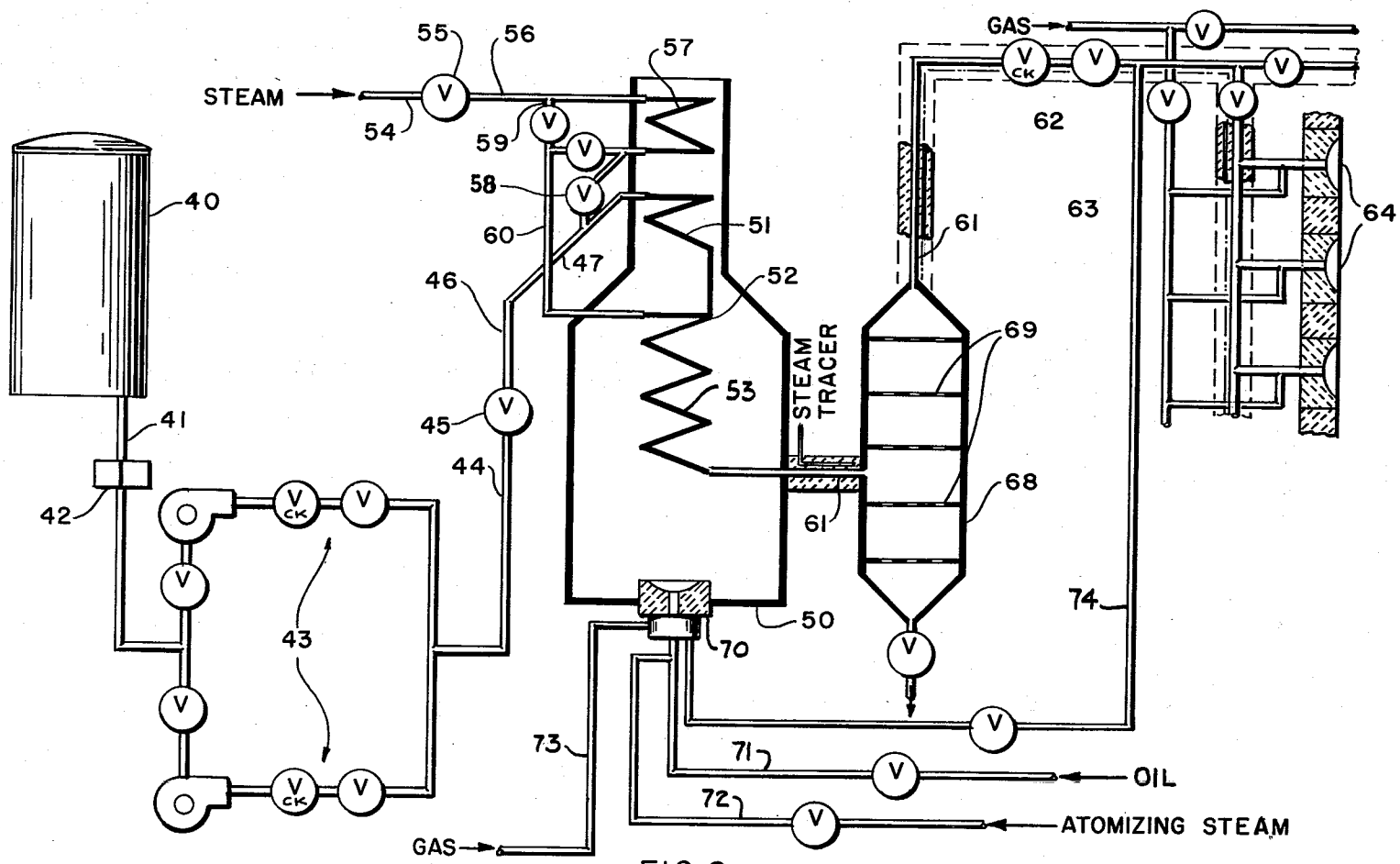

Referring to FIG. 2, the number 40 designates a storage tank for providing a hydrocarbon feed, through the line 41. This feed passes through a dual strainer 42 and then through a multiple valving system 43 to a liquid hydrocarbon delivery line 44. This line includes a flow control valve 45 regulated to deliver through the line 46 a supply of liquid hydrocarbon through the line 47 to a heater 50.

The liquid hydrocarbon feed stock from the line 47 passes through a hydrocarbon preheat coil 51, a steam injection point 52 and a mixed hydrocarbon and steam superheating coil 53. Steam is introduced through the line 54 and through pressure control valve 55 into a line 56 which leads to an optional superheating coil 57 contained in the heater 50. The steam, when superheated, is conducted through the line 60 to the steam injection point 52 where it is atomized into the hydrocarbon to form an atomized steam-hydrocarbon mix. When not superheated, the steam passes through line 59 to line 60. Line 58 is a steam purge line, used in start-up or shutdown, when the hydrocarbon feed line 47 is shut off.

After superheating, the atomized product passes out through the line 61 through appropriate valving 62 and is conducted to a header 63 and connected to a multiplicity of gas burners 64. Where heavy oil is used, the oil-steam mix is not vaporized to dryness and the heavy residue is separated out in a separating column 68, provided with sieve plates 69.

The heater or furnace 50 is energized by one or a plurality of burners as heretofore stated. In FIG. 2 a single burner 70 has been selected for illustration. It is provided with an oil line 71 and an atomizing steam line 72, and is also provided with a gas feed line 73. This burner 70 may be of a type especially constructed for the utilization of either oil or gas, if desired. A return line 74 is provided for returning the vaporized steam-hydrocarbon mix to the burner 70, as shown.

It will be appreciated that the specific forms of the apparatus and method shown in FIGS. 1 and 2 have been selected as illustrative of the invention, and are not intended to define or to limit the scope of the invention. Similarly, the following Examples are submitted as illustrative of the operation of the apparatus appearing in FIGS. 1 and 2, and are not intended to limit the scope of the invention.

EXAMPLE 1

As stated, it is important to provide a steam-hydrocarbon vapor mix which has, under the existing operating conditions, a Wobbe Number which is substantially equal to that of gas for which the gas burner was initially designed.

Utilizing a vaporized mix of 0.25 pound of steam per pound of No. 2 oil, the molecular weight of the mixture is 66. This mixture has a volume of 5.73 cubic feet per pound at 60° F., and of 13.36 cubic feet per pound at 750° F. The higher heating value of the mixture is 18,600/1.25 or 14,880 Btu per pound. Its specific gravity is 0.98 at 750° F. relative to air at 60° F.

Accordingly, the Wobbe Number of the mixture is its higher heating value in Btu per actual cubic foot divided by the square root of its specific gravity, or 14,880/13.36=1114 over the square root of 0.98 or 1125 Wobbe at operating conditions of 750° F.

By way of comparison, the specific gravity of natural gas (primarily methane) is 0.556 and its Wobbe Number is 1,020 divided by the square root of 0.556 or 1,370 assuming operating conditions of 60° F. Accordingly, the steam oil vaporized mix, being introduced to the burner at a temperature of 750° F., is compatible with a natural gas or methane feed at 60° F., since their Wobbe numbers are 1125 and 1370, respectively.

EXAMPLE 2

A series of tests was conducted on gasoil burning, by vaporizing the gasoil and mixing it with steam. The vaporized mixture was burned in a standard inspirating gas burner. The apparatus used was of the type illustrated in FIG. 1 of the drawings, modified for gasoil which was first partially vaporized and then mixed with steam. The vaporized mix was provided with a Wobbe Number comparable to that of natural gas, in order to provide the additional inspirating energy needed beyond that of vaporized oil. Tests were conducted to determine whether residue was prevented from forming in the vaporizer by passing steam with the oil through the vaporizer.

In the tests, stoichiometric ratios were obtained using the range of 0.25 pounds of steam per pound of hydrocarbon to 0.484 pound of steam per pound of hydrocarbon.

The gasoil used was somewhat similar to No. 2 oil. Usually, gasoil has a boiling range starting about 350° F. and a final boiling point about 750° F.

In starting up, the following procedure was utilized:

1. Set steam flow.
2. Light and adjust superheater
3. Insert lighting torch.
4. Turn on oil.
5. Check visually for burning conditions.
6. Reset steam and oil for operating conditions.

The following tests were conducted, with the operating conditions, orifice size, tip number and other conditions as set forth below:

TABLE 1

| Oil | Cap (Btu/hr/burner) (higher heating value) (H.H.V.) | Orifice | Tip | Pressure | Temp. | Steam # Oil # | Condition | Wobbe No. |
|---|---|---|---|---|---|---|---|---|
| #2 Oil | 250,000 | 24 | 300 | 5 | 750° F. | 0.484 | Stoichiometric | 795 |
| | 500,000 | | | 20 | | | | |
| | 750,000 | | | 45 | | | | |
| #2 Oil | 250,000 | 33 | 300 | 8 | 750° F. | 0.250 | Stoichiometric | 1125 |
| | 500,000 | | | 32 | | | | |
| #2 Oil | 250,000 | 24 | 303 | 6 | 750° F. | 0.615 | Stoichiometric | 687 |
| | 500,000 | | | 24 | | | | |
| PCI-Gas- | 250,000 | 24 | 300 | 3.5 | 750° F. | 0.240 | Stoichiometric | 1155 |
| Oil* | 500,000 | | | 13.5 | | | | |
| | 750,000 | | | 30 | | | | |
| "Solvasol" | 500,000 | 24 | 300 | 10 | 750° F. | 0.432 | Stoichiometric | 842 |

TABLE 1-continued

| Oil | Cap (Btu/hr/burner) (higher heating value) (H.H.V.) | Orifice | Tip | Pressure | Temp. | Steam # Oil # | Condition | Wobbe No. |
|---|---|---|---|---|---|---|---|---|
| #5 Naphtha | | | | | | | | |

*Heavier than #2 oil - has approximate average molecular weight of 250, as opposed to 200 for No. 2 oil and 150 for "Solvasol" naphtha #5.

The foregoing tests were conducted from day to day, utilizing different furnaces, and the results set forth above are averages. The test conditions varied only slightly day by day.

The #300 tip was a ceramic tip—two tips were used in testing. The first tip cracked through within an hour, but its condition remained stable over an estimated 40 hours of firing. The second tip did not crack after a total time of 20 hours firing. The tip was black on removal, however, indicating penetration of oil. Metal tips are preferred since they resist such penetration.

As a result of the foregoing tests, there was no evidence at any time of carbon residue in the furnace tubes. Both coil and straight tubes were used. There was no problem of flashback at a rate of 75,000 Btu per hour, with the best mixing set-up on the superheater and the best furnace conditions.

The tests showed that, in a hot furnace, conditions may be within the range of about plus or minus 25% of stoichiometric.

As a result of these tests, it was concluded that either saturated or superheated steam may be used at the point of mixing, that the steam and oil should preferably be introduced in parallel streams rather than at right angles, and that the velocity of the oil and steam at the point of mixing should be kept as high as possible. It was specifically established that an orifice for steam and an orifice for oil are entirely satisfactory in such a set-up, provided the velocities are substantially constant. Concentric tubes may be used, as an alternative.

Both gasoil and No. 2 oil were utilized in the foregoing tests, and both performed entirely satisfactorily.

EXAMPLE 3

Further tests were conducted utilizing an apparatus of the type illustrated in FIG. 2 of the drawing. Gasoil was used as the fuel. The pump P took direct suction on the cold gasoil tank and discharged into the lines 44, 46 leading directly into the fired vaporizer 50. The vaporizer was equipped with a single up-fired radiant burner identified as K976-17-300 (manufactured by Selas Corporation of America of Dresher, Pa.) with a 29MTD orifice. The gasoil was pumped to the helical coil in the vaporizer 50 at an inlet pressure of about 50 pounds per square inch gauge (p.s.i.g.). About halfway along the coil, high pressure steam was introduced at a ratio of 0.3 to 0.6 pound per steam per pound of oil. The gasoil-steam mix left the vaporizer at 707° F., which was in excess of the ASTM end point (645° F.) of the gasoil. This hot stream proceeded through the line 61, which was electrically heated and insulated, to the burners 64.

The vaporizer was dried out with steam in the coil, and by lighting the burner 70. The oil and steam flow were then adjusted at 330 and 165 pounds per hour respectively and the mixture was routed to the line 61. Changes were made with regard to the orifices in some of the burners, from 29 MTD to 24 MTD. After about 5 or 6 hours of operation at an outlet temperature of 707° F., there was no indication of incipient coking.

The following conditions were utilized in the performance of the foregoing tests.

| | | |
|---|---|---|
| FLOWS | | |
| Steam to vaporizer, lb/hr. | 154 | |
| Gasoil to vaporizer, lb/hr | 360 | |
| Steam/gasoil ratio, lb/lb. | 0.43 | |
| TEMPERATURES °F. | | |
| Steam to vaporizer | 536 | |
| Gasoil to vaporizer | 68 | |
| Vaporizer out | 707 | |
| Steam/oil at burners | 662 | |
| Fluegas vaporizer stack | 1148 | |
| Burner block on gasoil | 2210 | |
| Burner block on gas | 2245 | |
| Casing temperature behind burner | 248 | |
| PRESSURES, p.s.i.g. | | |
| Gasoil at pump discharge | 100 | |
| Gasoil at vaporizer inlet | 50 | |
| Vaporizer outlet | 43 | |
| Steam/G.O. at burners (3 burners on) | 21 | |
| Steam Pressure | 300 | |
| Fuel gas pressure to vaporizer | 11.5 | |
| Draft in vaporizer bottom | .63 | inch $H_2O$ |
| Product line | 7.5 | |

The nature of the gasoil used was as follows:

| GASOIL | | | |
|---|---|---|---|
| ASTM DIST | °F. | °C. | SP.GR.0.807 |
| IBP | 324 | 162 | |
| 10 | 344 | 173 | |
| 20 | 352 | 178 | |
| 30 | 361 | 183 | |
| 40 | 372 | 189 | |
| 50 | 388 | 198 | |
| 60 | 408 | 209 | |
| 70 | 442 | 228 | |
| 80 | 504 | 262 | |
| 90 | 568 | 298 | |
| FBP | 648 | 342 | |

The burners were used for supplying heat in a pyrolysis furnace for cracking gasoil to ethylene and other desired olefin products in externally heated stainless steel tubing.

EXAMPLE 4

Further tests were conducted utilizing the apparatus of FIG. 2 of the drawings, with further successful results. These further tests were utilized on a steam/gasoil mixture at a 0.45 ratio and a pressure of 20 p.s.i.g., using burner orifice 24 and tip #300. Several burners were thus operated in conjunction, and the operation of the apparatus showed that thorough mixing of the steam and gasoil is important to obtain at all burners. The burner pressures were varied between 14 and 28.5 p.s.i.g. without noticing any difference in cup appearance. The tests were conducted continuously for two days and were a complete success. It was established that the fuel should preferably arrive at all of the burners in a properly mixed condition, and that this can be accomplished by maintaining a high velocity in the burner headers and in the fuel return. The following operating conditions were utilized in the conduct of the test.

| Run No. | 1 | 2 | 3 | 4 | 5 |
|---|---|---|---|---|---|
| FLOWS LB/HR | | | | | |
| Steam to vaporizer | 155 | 132 | 132 | 132 | 132 |
| Gasoil to vaporizer | 340 | 353 | 342 | 342 | 353 |
| Steam/Gasoil ratio | 0.45 | 0.37 | 0.39 | 0.39 | 0.37 |
| Fuel Gas to Vaporizer BTU/hr fired HHV,MM | 6.55 | 6.88 | 6.55 | 6.55 | 6.88 |
| TEMPERATURES, °F. | | | | | |
| Steam to vaporizer | | | 540 | 540 | 540 |
| Gasoil to vaporizer | | 41 | 41 | 41 | 41 |
| Vaporizer outlet | | 645 | 645 | 645 | 645 |
| Steam/Gasoil at burners | | 662 | 716 | 716 | 702 |
| Fluegas to vaporizer Stack | | 1031 | 1220 | | |
| Burner block on Gasoil | | 2165 | 2192 | | |
| Burner block on gas | | 2265 | 2245 | | |
| Casing temperature highest | | 240 | 240 | | |
| PRESSURE, p.s.i.g. | | | | | |
| Gasoil at Pump discharge | 59.7 | 59.7 | 59.7 | 59.7 | 58.3 |
| Gas at vaporizer inlet | 52.6 | | 37.0 | 37.0 | 42.7 |
| Vaporizer outlet | 42.7 | | 27.0 | 25.6 | 32.7 |
| Steam/Gasoil at Burners | 21.3 | 19.9 | 19.9 | 17.1 | 25.6 |
| Draft vaporizer bottom inch WC | 0.32 | | | | |
| BURNERS ON GAS OIL | | | | | |
| Top row one side | 0 | 3 | 3 | 3 | 3 |
| Top row other side | 0 | 0 | 0 | 3 | 3 |
| Primary air | | | throttled | | |
| Secondary air | | | closed | | |

GAS OIL CHARACTERISTICS

| ASTM Distribution | °C. | °F. | |
|---|---|---|---|
| IBP | 164 | 327 | |
| 10 | 173 | 343 | |
| 20 | 178 | 352 | |
| 30 | 183 | 361 | |
| 40 | 190 | 374 | |
| 50 | 198 | 388 | |
| 60 | 210 | 410 | |
| 70 | 229 | 444 | |
| 80 | 264 | 507 | |
| 90 | 298 | 558 | Sp. Gr. at 15° C. 0.805 |
| FBP | 337 | 639 | |

EXAMPLE 5

Further tests were run on the apparatus described in the preceding test, which is substantially as shown in FIG. 2 of the drawings. The burners 64 were operated in an ethylene reactor furnace continuously for approximately a month and a half, and the furnace was then shut down in order to inspect the burners. The burners (6 in all) were removed from the furnace and inspected and it was observed that of the six burners tested three were undamaged, and that the others showed minor cracks. All of the tips were fit for further service. The vaporizer showed no signs of coking during the operation. The operating personnel reported that there was no irregularity in the burner operation, throughout the run, and that the operation was a success.

Further tests were conducted on a small scale, utilizing an apparatus of the type illustrated in FIG. 2 of the drawings, including a steam generator and a steam superheater for providing steam to the steam-oil mix point. Further, a separate oil preheater was provided, delivering preheated oil to the mix point and a further separate superheat furnace was provided for superheating the steam-oil vapor mix. The resulting superheated product was conducted to a furnace provided with an ejector blower, and a motorized damper in the flue stack. The burner was also connected to a source of high pressure gas, flowing through a flow meter and a gas solenoid.

These tests were conducted on a linear gas burner, and were conducted for the purpose of demonstrating the burner firing a mixture of steam and No. 2 fuel oil vapor in combination with natural gas at various proportions.

The burner tested was a natural draft burner with an adjustable air shutter. In this instance, draft was the primary means of introducing combustion air, and therefore the Wobbe number criteria for matching oil and gas were not required. The burner consisted of seven individual nozzles each with a 9/64" diameter gas orifice attached to a common manifold. Each nozzle was positioned inside its own individual circular ceramic vertical passage.

Air flow was controlled by means of an adjustable air shutter and furnace draft. A motorized damper in the flue stack controlled the furnace draft introduced by the ejector.

After the steam was generated it entered the steam superheater, which consisted of a stainless steel coil in a gas fired furnace, where it was heated to a temperature of 850° F. From there it passed through a #30 orifice, and met and mixed with preheated oil which was heated in the oil preheater to a temperature of 500° F. The mixture then entered a steam and vaporized oil superheater, and the mix was superheated to a controllable temperature and conducted to the burner manifold where it was either mixed with natural gas and burned, or burned in the absence of natural gas.

The various steam, oil and gas rates that were tested are summarized in a chart, Table 2, as follows:

TABLE 2

| Condition | Superheated Steam (°F.) | Preheated Oil (°F.) | #2 Oil Vapor & Steam Mixture (°F.) | Burner Manifold (°F.) | Furnace Temperature (°F.) | Burner Manifold Press (psi) | Furnace Draft (-in.W.C.) | Oil Flow (g.p.h.) | Natural Gas Flow (c.f.h.) | Steam (lbs./hr.) | Total Btu's Per Hr. (Millions) |
|---|---|---|---|---|---|---|---|---|---|---|---|
| 1 | — | — | — | 70 | — | 0.8 | .20 | 0 | 850 | 0 | 0.85 |
| 2 | — | — | — | 70 | — | 3.0 | .20 | 0 | 1700 | 0 | 1.70 |
| 3 | 945 | 450 | 1100 | 365 | 2020 | 4.1 | .20 | 3 | 1275 | 9 | 1.70 |
| 4 | 900 | 565 | 1000 | 390 | 1870 | 5.0 | .18 | 3 | 1275 | 13 | 1.70 |
| 5 | 965 | 485 | 1100 | 550 | 2040 | 4.7 | .22 | 6 | 850 | 10 | 1.70 |
| 6 | 965 | 485 | 1100 | 550 | 2040 | 4.7 | .22 | 6 | 850 | 16 | 1.70 |
| 7 | 700 | 415 | 1000 | 700 | 2090 | 4.5 | .20 | 9 | 430 | 12 | 1.70 |
| 8 | 850 | 430 | 850 | 635 | 2220 | 5.5 | .20 | 9 | 430 | 27 | 1.70 |
| 9 | 810 | 465 | 900 | 670 | 2210 | 8.4 | .20 | 9 | 430 | 40 | 1.70 |
| 10 | 825 | 470 | 800 | 715 | 2195 | 2.0 | .25 | 12 | 0 | 16 | 1.70 |
| 11 | 890 | 460 | 800 | 700 | 2175 | 2.5 | .25 | 12 | 0 | 22 | 1.70 |

TABLE 2-continued

| Condition | Superheated Steam (°F.) | Preheated Oil (°F.) | #2 Oil Vapor & Steam Mixture (°F.) | Burner Manifold (°F.) | Furnace Temperature (°F.) | Burner Manifold Press (psi) | Furnace Draft (-in.W.C.) | Oil Flow (g.p.h.) | Natural Gas Flow (c.f.h.) | Steam (lbs./hr.) | Total Btu's Per Hr. (Millions) |
|---|---|---|---|---|---|---|---|---|---|---|---|
| 12 | 965 | 365 | 1000 | 685 | 2310 | 4.0 | .25 | 12 | 0 | 29 | 1.70 |
| 13 | 850 | 510 | 800 | 720 | 2030 | 5.0 | .18 | 12 | 0 | 40 | 1.70 |
| 14 | 820 | 460 | 1000 | 810 | 2200 | 5.0 | .20 | 9 | 0 | 40 | 1.27 |
| 15 | 865 | 510 | 1000 | 840 | 1960 | 2.0 | .22 | 6 | 0 | 16 | .85 |
| 16 | 920 | 565 | 1000 | 840 | 1890 | 2.5 | .20 | 6 | 0 | 27 | .85 |
| 17 | 830 | 615 | 1000 | 840 | 1840 | 3.5 | .20 | 6 | 0 | 40 | .85 |

In operation, the burner was started cold using natural gas. After the furnace reached its operating temperature of approximately 1800° F., steam and vaporized oil were added to the gas and the gas was decreased in the amounts shown in Table 2, to maintain 100% capacity or 1.7 MM per hour. Starting from 100% gas (no steam and vaporized oil) and proceeding through the range to 0 gas and 100% steam and vaporized oil, the percentage of gas to steam and vaporized oil was changed in 25% increments. The steam-oil mix was varied in the range between 0.15 and 0.5 pounds of steam per pound of oil.

The burner performed normally during the entire procedure. As superheated steam and vaporized oil were added the burner appearance changed slightly showing traces of visible flame. Different steam rates were utilized under every condition. As the ratio of oil to gas increased the flame became more luminous. This change was especially evident at 75% steam and vaporized oil and 25% gas (conditions 7 through 9 in Table 2). The burner performed quite satisfactorily under all these different conditions, and this test further established that numerically lower oil-to-steam ratios can be tolerated when firing more gas.

Accordingly, it will be appreciated that we have created a process for steam vaporization of a liquid hydrocarbon consisting essentially of oil or naphtha having an API gravity value of about 10 to 80, in a manner to produce a mixture which is substantially completely interchangeable with gas. The steam-hydrocarbon mixture is intended to be introduced to the burner nozzle at a predetermined elevated temperature, in order to provide a mixture having a Wobbe number essentially equivalent to the Wobbe number of gas, which is usually at substantially ambient temperature. In order to achieve this, the liquid hydrocarbon is preheated and is mixed with steam in a quantity of about 0.1 to 1 pound of steam per pound of hydrocarbon. The liquid hydrocarbon and the steam are mixed and brought to a pressure of about 30 to 150 pounds per square inch gauge. The resulting mixture is heated to a mixture temperature which is above the condensation temperature of the mixture at the nozzle, and which temperature is usually approximately in the range of about 450° F. to 800° F. The resulting mixture of hydrocarbon and steam is delivered as a vaporized mixture to the nozzle of the gas burner, and is burned in the gas burner in the same manner as gas. As stated, the liquid hydrocarbon is preferably a petroleum fraction, still more preferably selected from the group consisting of naphtha, gasoil and heating oils in the range of No. 2 to No. 6.

As has been disclosed herein, it is highly desirable, after the formation of the steam-hydrocarbon mixture, to deliver it in such a manner that it remains heated and insulated in order to avoid condensation of oil or steam in the delivery pipe line. Since such delivery pipe lines are frequently rather lengthy, and may even be exposed to severe ambient conditions including extremely cold weather, it is highly desirable to provide a steam tracing line or an electrical tracing line, together with appropriate insulation, in order to avoid condensation en route to the burner nozzles.

In performing the mixing operation the steam may be either saturated steam or superheated steam, and if superheated the steam may have a temperature in the range from about the temperature of saturated steam at about 30 p.s.i.g. (275° F.), up to about 800° F. In performing the mixing operation, the hydrocabon may be partially in the liquid form at the time that it is mixed with the steam, or in some cases, particularly including the light hydrocarbons such as naptha, it may be completely vaporized prior to the time that it is mixed with the steam. In some cases the hydrocarbon may even be vaporized and superheated before it is mixed with the steam, but care should be exercised to avoid occurrence of coking. When relatively heavy oils are utilized as the hydrocarbon, it is preferable to preheat the hydrocarbon and to mix it with steam while it is partially in the liquid phase, and then to vaporize and superheat the steam and hydrocarbon as a mixture. When saturated steam is used, care should be taken to prevent its condensation in the heater coils.

In the utilization of relatively light hydrocarbons, particularly those containing impurities, it is highly desirable to flash the hydrocarbon prior to the mixing step, and to remove the bottoms containing impurities therefrom. The bottoms may either be burned to produce heat for the preheating step, or for the heating step, or for any other purpose.

Similarly, the vaporized hydrocarbon-steam product may be returned to the preheating step and burned in a manner to provide heat for the preheating step, or may be burned separately. A portion of it may be returned to a boiler to produce at least a portion of the steam that is used in the process.

Preferably, as stated, the mixing of hydrocarbon and steam is accomplished by conducting them together in substantially parallel streams. An orifice may be provided for the hydrocarbon and a separate orifice for the steam, at or adjacent the mixing point.

In the utilization of a rather heavy hydrocarbon, it is often found desirable to limit the extent of vaporization so that the vaporization process does not proceed to dryness. In such a case, unvaporized hydrocarbon residues pass through the heater and superheater coils, and may be removed from the product line by a suitable separation column or the like. The bottoms from such a separation column may be burned separately, either in a boiler or elsewhere. Such bottoms usually contain impurities, and this aspect of the process results in a vaporized hydrocarbon from which such impurities have been removed.

Although this invention has been described with reference to particular process flow diagrams and to particular arrangements of apparatus, it will be appreciated that these have been utilized as exemplary of the invention, and neither they nor the specific descriptions in the specification which relate to them are intended to define or to limit the scope of the invention. It will be appreciated that equivalent elements may be used for those specifically shown and described, that certain features of the invention may be utilized independently of other features, and that certain method steps may be reversed in order, all without departing from the spirit and scope of this invention as defined in the appended claims.

I claim:

1. In a process for steam vaporization of a liquid hydrocarbon consisting essentially of oil or naptha having an API gravity of about 10–80 for introduction at a predetermined steam-hydrocarbon nozzle temperature into the nozzle of a burner, said burner being constructed for burning a gas of a predetermined Wobbe number, at a predetermined nozzle gas temperature, the steps which comprise:

preheating said liquid hydrocarbon to a preselected temperature so that it is at least partially in the vapor phase, supplying steam in the quantity of about 0.1 to 1 pound of steam per pound of said hydrocarbon, mixing said preheated hydrocarbon with said steam at a pressure of about 30–150 pounds per square inch gauge, heating the resulting mixture to a mixture temperature in the range of 450° to 800° F., said mixture temperature being above the condensation temperature of the mixture at the nozzle, and said mixture temperature being such as to impart to said resulting mixture a Wobbe number essentially equivalent to the predetermined Wobbe number of said gas at said predetermined nozzle gas temperature, delivering said hydrocarbon and steam as a vaporized mixture to the nozzle of said gas burner, and burning said vaporized mixture in said gas burner.

2. The process according to claim 1, wherein said liquid hydrocarbon is a petroleum fraction.

3. The process according to claim 2, wherein said petroleum fraction is selected from the group consisting of naphtha, kerosene and heating oils in the range of No. 2 to No. 6.

4. The process according to claim 1, including the further step of heating and insulating the steam-oil mixture while delivering said mixture from said heating step to said burning step.

5. The process according to claim 1, wherein said gas of predetermined Wobbe number is in the range of about 500 to 1,500 at 60° F., and wherein said mixture of liquid hydrocarbon and steam also has a Wobbe number, at the nozzle temperature, of about 500 to 1,500.

6. The process according to claim 5, wherein said mixture has a Wobbe number of about 1000–1500.

7. The process according to claim 1, wherein the steam is provided in a quantity of about 0.2 to 0.4 pounds of steam per pound of liquid hydrocarbon.

8. The process according to claim 1, wherein the steam supplied to the hydrocarbon is saturated steam.

9. The process according to claim 1, wherein the steam supplied to the hydrocarbon is superheated steam.

10. The process in accordance with claim 9, wherein the superheated steam temperature is about 275° to 800° F.

11. The process according to claim 1, wherein the hydrocarbon is vaporized prior to the time it is mixed with the steam.

12. The process according to claim 1, wherein the hydrocarbon is vaporized and superheated.

13. The process according to claim 1, wherein gas is fed concurrently with said mixture to said gas burner, and wherein said gas is burned concurrently with said mixture of hydrocarbon and steam in said burner.

14. The process according to claim 1, including the step of switching over said burning step from burning gas exclusively to burning said mixture of hydrocarbon and steam exclusively.

15. The process according to claim 1, including the step of switching over from burning said hydrocarbon and steam mixture exclusively to burning said gas exclusively.

16. The process according to claim 1, wherein the hydrocarbon is preheated and mixed with steam, and wherein both said steam and hydrocarbon are superheated as a mix.

17. The process according to claim 1, further including the preliminary step of starting up the system by purging air from the hydrocarbon lines by running steam therethrough, and characterized by the further step of preliminarily heating the steam-hydrocarbon lines by running steam therethrough.

18. The process according to claim 1, wherein said steam is saturated steam at a pressure of about 75 to 125 pounds per square inch gauge.

19. The process according to claim 1, wherein, prior to said mixing step, at least a part of said hydrocarbon is flashed and bottoms containing impurities are removed therefrom.

20. The process according to claim 19, wherein said bottoms are burned to produce heat for said preheating step.

21. The process according to claim 1, wherein a portion of the vaporized hydrocarbon-steam product is returned to the preheating step and is burned in a manner to provide heat for said preheating step.

22. The process according to claim 1, wherein a portion of the vaporized product is burned separately.

23. The process according to claim 1, wherein a portion of the vaporized hydrocarbon-steam product is returned to the preheating step and is burned in a manner to provide heat for said preheating step, and wherein a portion of the product is burned in a boiler to produce at least a portion of said steam.

24. The method defined in claim 1, wherein the mixing of hydrocarbon and steam is accomplished by conducting them together in substantially parallel streams.

25. The process according to claim 1, wherein said burning step is caused to provide heat in a hydrocarbon reaction in which the hydrocarbon is converted into reaction products in externally heated stainless steel tubing.

26. The process in accordance with claim 1, wherein said resulting mixture is heated to a temperature in the range of 450° to 800° F., to provide said mixture with a Wobbe number essentially equal to the Wobbe number of said gas.

27. Apparatus for burning either liquid hydrocarbon or gas comprising a gas burner having nozzle means for burning air and gas, said gas having a predetermined Wobbe number at a predetermined nozzle gas temperature, a gas conduit connected thereto, means for supplying liquid hydrocarbon to a vaporizing apparatus, means for supplying steam to said vaporizing apparatus, said vaporizing apparatus comprising means for preheating said liquid hydrocarbon to a predetermined temperature to at least partially vaporize said hydrocarbon, means for mixing said preheated hydrocarbon with steam at a ratio of about 0.1 to 1.0 pound of steam per pound of hydrocarbon under pressure in the range of about 30 to 150 pounds per square inch gauge, means for heating said mixture to a temperature in the range of about 450° to 800° F. whereby said mixture has essentially the equivalent Wobbe number as said gas at said burner nozzle, and means for feeding said heated mixture to said gas burner nozzle.

28. The apparatus defined in claim 27, wherein means are provided for distilling said hydrocarbon and for separating bottoms therefrom, and wherein means are provided for conducting said distilled hydrocarbon to said means for mixing said hydrocarbon with said steam.

29. The apparatus defined in claim 27, wherein means are provided for introducing said steam into said hydrocarbon downstream of said means for preheating said hydrocarbon, and wherein said means is connected to a means for vaporizing said hydrocarbon in admixture with said steam as a part of said mixing means.

30. The apparatus defined in claim 27, wherein means are provided to adjust said burner for burning said gas having a predetermined Wobbe number, and wherein said means for heating said mixture includes a control means for controlling the temperature of the resulting mixture to cause it to have a Wobbe number substantially equivalent to the Wobbe number to which said burner is adjusted.

31. The apparatus defined in claim 27, wherein said burner is an inspiration burner.

32. The apparatus defined in claim 27, wherein said burner is a nozzle mix burner.

33. The apparatus defined in claim 27, wherein said burner is a natural draft burner.

34. The apparatus defined in claim 27, wherein said burner is a forced draft burner.

35. The apparatus according to claim 27, wherein means are provided for returning a portion of the preheated hydrocarbon for burning in a manner to provide heat for said preheating step.

36. The apparatus according to claim 27, wherein means are provided for burning a portion of the product in a boiler to produce at least a portion of said steam.

37. The apparatus according to claim 27, wherein means are provided for returning a portion of the product to preheat said hydrocarbon, and wherein a portion of said product is also provided with return means for burning said portion in a boiler to produce at least a portion of said steam.

38. The apparatus defined in claim 27, wherein said burner has a metal tip.

39. The apparatus defined in claim 27, further including the provision of means forming substantially parallel streams for mixing said hydrocarbon and said steam in substantially parallel streams.

40. The apparatus defined in claim 39, further including the provision of an orifice for said hydrocarbon and a separate orifice for said steam at or adjacent the mixing point.

41. Apparatus for burning either liquid hydrocarbon or gas comprising a gas burner having nozzle means for burning air and gas, said gas having a predetermined Wobbe number at a predetermined nozzle gas temperature, a gas conduit connected thereto, means for supplying liquid hydrocarbon to a vaporizing apparatus, means for supplying steam to said vaporizing apparatus, said vaporizing apparatus comprising means for preheating said liquid hydrocarbon to a predetermined temperature to at least partially vaporize said hydrocarbon, means for mixing said preheated hydrocarbon with steam at a ratio of about 0.1 to 1.0 pound of steam per pound of hydrocarbon under pressure in the range of about 30 to 150 pounds per square inch gauge, means for heating said mixture to a temperature in the range of about 450° to 800° F. whereby said mixture has essentially the equivalent Wobbe number as said gas at said burner nozzle, and means for feeding said heated mixture to said gas burner nozzle, further comprising means for distilling said hydrocarbon and for separating bottoms therefrom, and wherein means are provided for conducting said distilled hydrocarbon to said means for mixing said hydrocarbon with said steam.

* * * * *